US006428156B1

(12) United States Patent
Waller et al.

(10) Patent No.: US 6,428,156 B1
(45) Date of Patent: Aug. 6, 2002

(54) INK DELIVERY SYSTEM AND METHOD FOR CONTROLLING FLUID PRESSURE THEREIN

(75) Inventors: David J. Waller, Fort Collins, CO (US); Melissa D. Boyd; John M. Koegler, III, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/432,453

(22) Filed: Nov. 2, 1999

(51) Int. Cl.[7] ..... B41J 2/18
(52) U.S. Cl. ..... 347/89
(58) Field of Search ..... 347/89, 85, 92, 347/18

(56) References Cited

U.S. PATENT DOCUMENTS

| | | | | |
|---|---|---|---|---|
| 3,596,275 A | | 7/1971 | Sweet | |
| 4,929,963 A | | 5/1990 | Balazar | |
| 5,084,713 A | | 1/1992 | Wong | |
| 5,211,493 A | | 5/1993 | Stephenson et al. | 400/719 |
| 5,446,486 A | * | 8/1995 | Reis | 347/85 |
| 5,459,498 A | | 10/1995 | Seccombe et al. | 347/18 |
| 5,552,815 A | | 9/1996 | Shimoda | 347/85 |
| 5,619,236 A | | 4/1997 | Keefe et al. | 347/84 |
| 5,646,666 A | | 7/1997 | Cowger et al. | 347/87 |
| 5,691,754 A | | 11/1997 | Ta | 347/85 |
| 5,818,485 A | * | 10/1998 | Rezanka | 347/89 |
| 5,880,748 A | | 3/1999 | Childers et al. | 347/6 |
| 5,980,034 A | * | 11/1999 | Tsai et al. | 347/89 |

* cited by examiner

*Primary Examiner*—Judy Nguyen

(57) ABSTRACT

An actively-controlled recirculating ink delivery system is provided that incorporates active control of pressures downstream of the printhead. This is achieved through the use of a device (such as a pump, return valve, combination thereof or similar devices) that provides active control of downstream ink pressures. A pressurized ink supply, pressure sensors, an air and heat exchanger are also provided, thereby improving start up, normal operation, purging and shut down procedures. Because the pressurized ink supply is not restricted to sit at a particular vertical distance below the printhead, backpressure may be changed quickly and easily through electronic control, and system priming is considerably quicker than with conventional air-pressurized systems.

13 Claims, 5 Drawing Sheets

INK DELIVERY SYSTEM AND METHOD FOR CONTROLLING FLUID PRESSURE THEREIN

TECHNICAL FIELD

The present invention relates generally to inkjet printers and, in particular, to an ink delivery system and method for controlling fluid pressure therein.

BACKGROUND OF THE INVENTION

Many manufacturers of inkjet printers today expend considerable effort toward developing higher-performing and longer-lasting inkjet printheads. The typical inkjet printhead comprises a silicon substrate, structures built on the substrate, and connections to the substrate. Such a printhead typically uses liquid ink (i.e., dissolved colorants or pigments dispersed in a solvent). The printhead has an array of precisely formed orifices or nozzles attached to the substrate that incorporates an array of ink ejection chambers which receive liquid ink from an ink reservoir. Each chamber is located opposite the nozzle so ink can collect between it and the nozzle. The ejection of ink droplets is typically under the control of a microprocessor, the signals of which are conveyed by electrical traces to resistor elements on the substrate. When electric printing pulses heat a resistor element, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

Unfortunately, the ability of traditional ink delivery systems to meet printhead thermal demands arising from higher drop firing frequencies, denser resistor spacing, larger die sizes, and decreased ejection efficiency is in doubt. In addition, current ink delivery systems struggle to manage air and particles in the printhead so that its long-term reliability is not compromised. These problems are compounded when supplying ink to an array of printheads.

Recirculating ink delivery systems have been proposed by many as a solution to these problems. While these systems are generally capable of removing heat, air and particles, they typically rely on passive hydrostatics (fluid column height relative to the printhead) to maintain appropriate backpressure at the printhead. "Backpressure" is the term used to describe what is typically a slightly negative pressure relative to atmospheric pressure at the printhead that prevents ink from leaking out of the printhead nozzles in between periods of active ink ejection. Care must be exercised in setting such backpressures. An overly large backpressure (i.e., an excessively negative pressure) will prevent ink from being drawn through the printhead, thereby "starving" the printhead of ink. An overly small backpressure (i.e., an insufficiently negative or even positive pressure) will cause too much ink to flow out of the printhead nozzles, thereby causing the printhead to "drool" excess ink.

A system relying on passive hydrostatics to control backpressure is illustrated, for example, in U.S. Pat. No. 4,929,963. While these systems are effective, they appear to be generally limited to precisely-positioned arrangements that consume considerable space. In addition, backpressure adjustments done by reservoir positioning systems add to cost and are similarly space-consuming. Finally, pressure-priming of the ink delivery system and printhead typically requires pressurizing air above a fluid reservoir, resulting in lengthy startup and service times.

To overcome some of these shortcomings of the prior art, active-control ink delivery systems have been proposed.

Generally, these systems have controlled backpressures by modulating ink pressures upstream of the printhead (i.e., in the ink supply side of the printhead). For example, U.S. Pat. No. 5,880,748 illustrates an actively controlled ink delivery system in which ink pressures upstream of the printhead are monitored and, when necessary, used to control a valve which affects the backpressure of the ink being delivered to the printhead. Likewise, U.S. Pat. No. 5,646,666 teaches the use of a pump and vacuum regulator for maintaining a partial vacuum, and hence a slight backpressure, at the ink reservoir supplying the printhead. The current state of the art with respect to active control of backpressures in ink delivery systems has not, however, addressed the possibilities for regulating backpressures through the active control of pressures downstream of the printhead (i.e., in the ink return side of the printhead). Thus, it would be advantageous to provide a an ink delivery system that incorporates active pressure control downstream of the printhead.

SUMMARY OF THE INVENTION

The present invention provides an actively-controlled recirculating ink delivery system that overcomes the shortcomings of prior art systems and incorporates active control of downstream pressures to control backpressure. Generally, this is achieved through the use of a device that provides active control, when needed, of downstream ink pressures. Such a device may comprise a pump, a return valve, combination thereof or other similar devices. The present invention also incorporates the use of a pressurized ink supply, pressure sensors, an air and heat exchanger, and other components such as a compliant element, filters, and thermocouples to further refine and improve performance of the ink delivery system. Because the pressurized ink supply is not restricted to sit at a particular vertical distance below the printhead, backpressure may be changed quickly and easily through electronic valve control, and system priming is considerably quicker than with conventional air-pressurized systems.

DETAILED DESCRIPTION OF THE INVENTION

Figure 1:
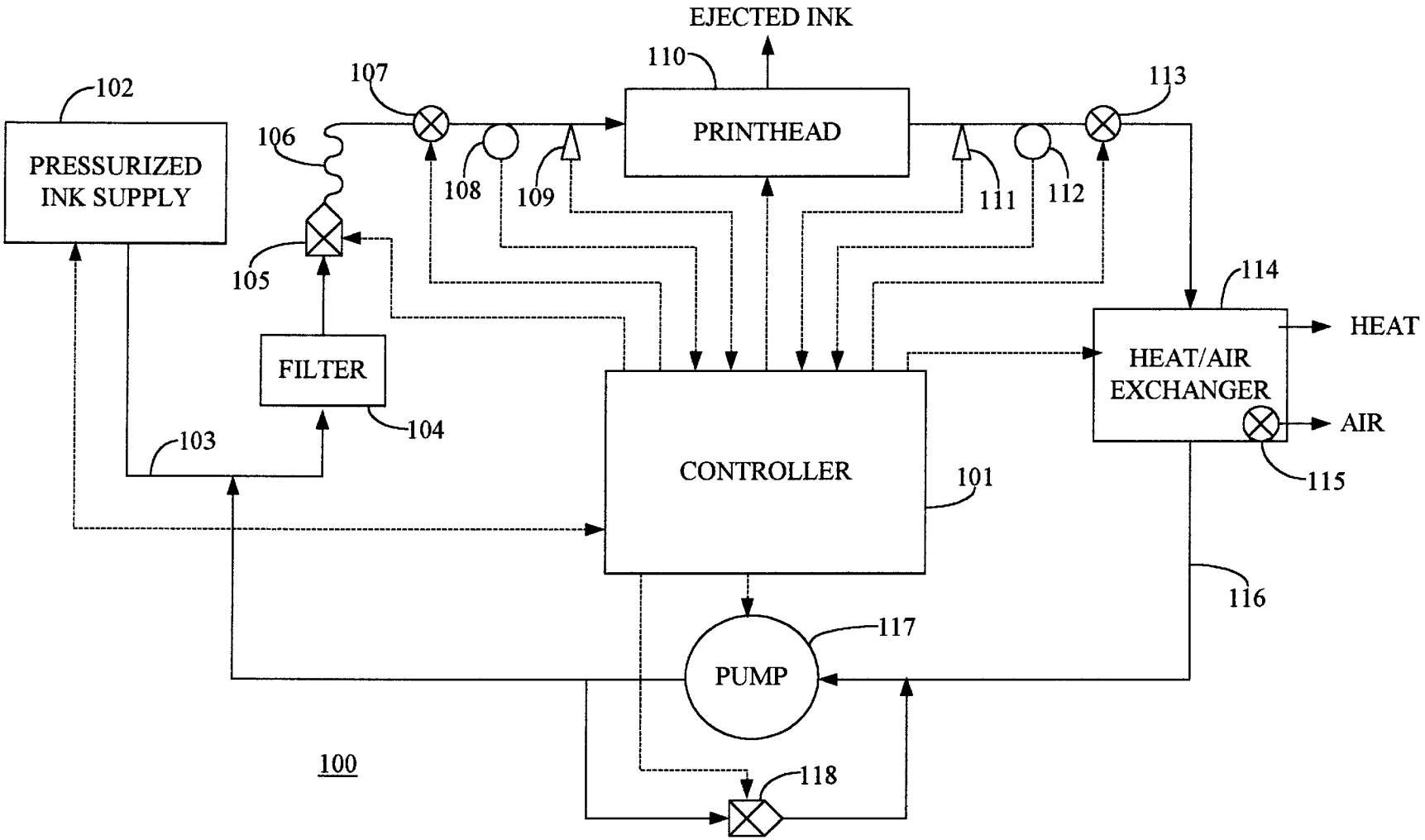
FIG. 1 is a block diagram of an ink delivery system in accordance with the present invention.

The present invention may be more fully described with reference to FIGS. 1–5. Referring now to FIG. 1, an ink delivery system 100 is illustrated comprising a controller 101, a pressurized ink supply 102, a supply line 103, a filter 104, a supply valve 105, a compliant element 106, entrance and exit valves 107, 113, an entrance and exit pressure sensor 108, 112, an entrance and exit thermocouple 109, 111, a printhead 110, a heat/air exchanger 114 comprising an exchanger valve 115, a return line 116, a pump 117 and a return valve 118 arranged as shown. Those having ordinary skill in the art will recognize, particularly in light of the following description, that other configurations are possible, including the addition of other elements or the removal of some of the elements shown. At a minimum, the present invention incorporates means for controlling pressures downstream of the printhead 110. In a preferred embodiment, such means comprise a pump, a return valve, combination thereof or functionally similar devices. In the exemplary system illustrated in FIG. 1, both a pump 117 and a return valve 118 are incorporated, as described in further detail below.

The controller 101 controls the recirculating ink delivery system 100. The controller 101 may comprise any of a microcontroller, microprocessor, digital signal processor or the like, or any combination thereof, executing stored software instructions. As shown, the controller accepts input from the pressure sensors 108, 112, thermocouples 109, 111, and ink supply 102 and, based on these inputs, provides control of the various valves 105, 107, 113, 115, 118, ink supply 102, pump 117, and printhead 110.

The pressurized ink supply 102 supplies pressurized ink via the supply line 103 through the filter 104 to the supply valve 105. The pressurized supply also accepts recirculated ink from the pump 117. A suitable pressurized ink supply 102 is a Mirage Ink Supply Station (ISS), currently used in some Hewlett-Packard Co. "DESIGNJET™" printers, which pressurizes ink in Mirage ink containers with a built-in air pump. When the Mirage ISS is used, ink supply pressure is controlled by the controller 101 based upon pressure sensor feedback and a relief valve, both of which are also built into the ISS (not shown in FIG. 1). One Mirage ISS is capable of supplying up to four channels of ink and multiple ISSs may be used as a matter of design choice. Preferably, the supply line 103 is isobaric as determined by the output pressure of the pressurized ink supply 102 and the high-side pressure of the pump 117. Because the pressurized ink supply typically incorporates an ink-filled bladder surrounded by pressurized air, the compliance provided by the bladder absorbs any pressure fluctuations arising in the supply line 103.

The supply line 103, the return line 116 and all other conduits of ink (i.e., ink tubing) are preferably chemically inert, have low vapor and air permeability, are flexible enough for the required routing, and do not cause unacceptable fluidic drag. It is anticipated that suitable ink tubing includes either ⅛" Teflon-lined Tygon or other tubing used in current Hewlett-Packard Co. printer products. Coupled to the supply line 103, the filter 104 removes particles from entering the supply valve 105 and the printhead 110. Although the filter 104 is shown upstream relative to the supply filter, those having ordinary skill in the art will recognize that filters may also be placed elsewhere in the system, such as after the supply valve 105 or before the return valve 118. Each ink channel requires its own filtration, and it is anticipated that suitable filters are in-line, 5 $\mu$m pore-size filters.

The supply valve 105 regulates backpressure by controlling ink flow to the printhead 110. The supply valve 105 requires high-frequency operation, chemical inertness, and the ability to deliver either sub-atmospheric or pressurized ink to the supply line. As shown, the controller 101 controls the operational state of the supply valve 105. During normal operation, the supply valve 105 is cycled on and off, or controlled in an analog non-binary manner, according to pressure sensor feedback fed to controller logic, and will be normally closed without power to prevent unwanted ink flow. Each ink channel, in those instances where there are multiple ink channels, will have its own supply valve. It is anticipated that suitable valves for the supply valve are Micro-Inert valves or INKA Inkjet valves from The Lee Co., or custom microvalves.

The compliant element 106 is included to primarily absorb pressure fluctuations arising from changes in the operating state of the supply valve 105. That is, the compliant element 106 essentially acts as a low pass filter, filtering out any high frequency fluctuations in pressure. Each ink channel requires its own compliant element. In practice, the compliant element may comprise a compliant section of tubing, a small chamber with a compliant wall, a spring-loaded bag or any similar device offering the same frequency filtering characteristics.

As shown in FIG. 1, there is an entrance valve 107 and an exit valve 113 (per ink channel) upstream and downstream, respectively, of the printhead 110. Suitable valves are direct-lift solenoid valves, as known in the art. The entrance and exit valves 107, 113 function as shut-off valves to prevent ink flow through the printhead 110 during start up, shut down and purging procedures. These procedures are described in greater detail relative to FIGS. 2 and 4–5 below. Additionally, the entrance and exit valves 107, 113 act as a redundant system to prevent ink leakage in the event that another valve fails or leaks.

Entrance and exit pressure sensors 108, 112 (per ink channel) are positioned upstream and downstream, respectively, of the printhead 110 and provide entrance and exit pressure signals to the controller 101. The signals may be continuously supplied to the controller, or the sensors may be periodically polled. For example, during normal operation, the signals may be continuously supplied to the controller and periodically supplied during periods of non-use while still powered. In a preferred embodiment, the pressure sensors 108, 112 comprise micromachined pressure sensors in order to minimize space requirements thereby allowing them to be mounted immediately up- and downstream of the printhead 110 or on the printhead itself. They may also be integrally manufactured with the printhead as well. The pressure sensors are preferably chemically inert and exhibit acceptable signal/noise performance, as known in the art. It is anticipated that suitable pressure sensors 108, 112 are Lucas-NovaSensor micromachined pressure sensors.

Entrance and exit thermocouples 109, 111 (per ink channel) are positioned upstream and downstream, respectively, of the printhead 110 and provide entrance and exit temperature signals to the controller 101. As with the pressure sensors, the thermocouples 109, 111 may be mounted to the printhead or integrally manufactured with the printhead. The information regarding ink temperature may be used to adjust ink flowrate or printhead firing. As shown, the thermocouples 109, 111 are most logically positioned immediately up- and downstream of the printhead 110, although other positioning arrangements and/or additional thermocouples may be used. It is anticipated that suitable thermocouples 109, 111 are Omega thermocouples.

The printhead 110 is an individual die or an array of die attached to a manifold or other suitable ink delivery component containing an appropriate number of flow channels.

Ink entering the printhead 110 (through a printhead entrance) is either ejected as a drop, drawn during a service routine, or exits the printhead 110 (through a printhead exit) and recirculated. During start up, purging and shut down procedures, the printhead nozzles must be blocked if ink flowing from the nozzles is to be prevented.

As known in the art, ink leaving the printhead 110 may carry with it air and heat, both of which are preferably removed from the system to ensure optimum performance. To this end, the heat/air exchanger 114 is provided and functions, using known techniques, so that entrained air is captured, stored, and released with an electronically- or mechanically-controlled valve 115 (similar to the entrance and exit valves 107, 113). The stored air also acts as a complaint element in the return line 116 from the printhead 110, thereby absorbing pressure fluctuations arising from operation of the pump 117 or return valve 118. The exchanger 114 also functions to remove air during system start up and purging procedure, as described below. Likewise, the heat exchanging function, implemented, for example, using known heat exchanger techniques, serves to remove excess heat from the system. Each ink channel has its own exchanger 114, although they may share common components, such as a cooling system. Furthermore, although the exchanger 114 is illustrated as a unitary element in FIG. 1, it is understood that the heat and air exchanging functions could be performed by physically separate devices or separate devices that have been joined together. A filter may also be included in the exchanger 114 (not shown) to catch particles and air, if necessary.

Unlike prior art ink delivery systems, the present invention provides mechanisms downstream of the printhead 110 for controlling backpressure in the printhead 110. In particular, such mechanisms include, but need not be limited to, the pump 117 and/or the return valve 118. The pump 117 draws unprinted ink from the printhead 110 and returns it to the pressurized ink supply 102. The pump 117 can be an individual pump for each ink channel or a single unit pumping all channels. Individual pumps offer the greatest flexibility for individual channel flowrate control. However, a single pump may also be used across multiple ink channels if overdriven appropriately because, in one embodiment of the present invention, the supply and return valves 105, 118 regulate the backpressure, and thereby the flowrate, in each ink channel. For example, a single Ismatec peristaltic pump can be used to drive all ink channels. As noted above the supply and return valves 105, 118 are used to regulate backpressure in one embodiment of the present invention. However, it is recognized that the pump 117 alone, particularly in those situations where each ink channel has its own pump, could be used to regulate backpressures based on control signals provided by the controller 101. In those embodiments where it is included (i.e., where a single pump drives multiple ink channels), the return valve 118 regulates the pressure for its corresponding ink channel downstream of the printhead 110 by allowing pressurized ink from the supply line 103 into the return line 116. This would occur, for example, if the exit pressure sensor 112 reports that the backpressure at the exit of the printhead 110 is too great (i.e., too negative). The same type of valve used to for the supply valve 105 may be used for the return valve 118.

Figure 2:
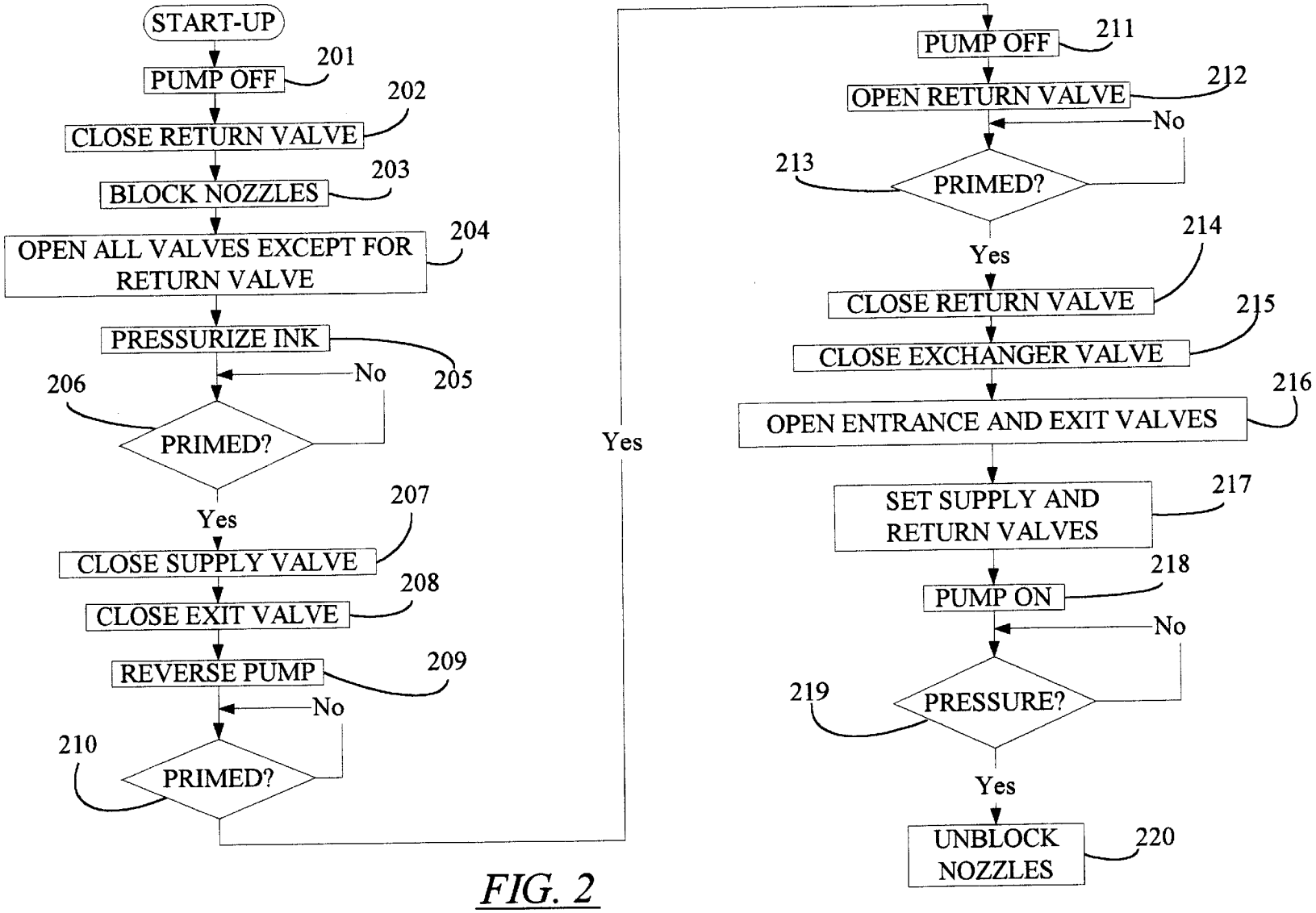
FIG. 2 is flowchart of a start up procedure for use in an ink delivery system in accordance with the present invention.

FIGS. 2–5 illustrate procedures relating to the operation of the ink supply system 100 illustrated in FIG. 1. In a preferred embodiment, the controller 101 using known software programming techniques implements the procedures illustrated in FIGS. 2–5. Referring now to FIG. 2, a start up procedure is illustrated. At steps 201–203, the pump is switched off (if it isn't already), the return valve is closed and the nozzles of the printhead are blocked. At step 204, all remaining valves (entrance, exit, supply and exchanger valves) are opened and, at step 205, the ink supply is pressurized. This will force ink to flow from the pressurized ink supply, through the supply line and printhead, filling and displacing air out of the exchanger. Once it is determined (for example, by waiting a predetermined period of time), at step 206, that the supply line and printhead have been primed, the supply valve is closed at step 207.

With the Supply Valve closed, thereby preventing further flow of ink to the printhead, the exit valve is closed at step 208, thereby preventing the flow of ink away from the printhead. At step 209, the pump is activated in the reverse direction so that ink flows from the pressurized ink supply through the return line to the exchanger. The exchanger then fills further with ink, displacing air out its open valve. When the return lines are primed, as determined at step 210, the pump is turned off at step 211.

With the pump off and exit valve closed, the return valve is opened at step 212. As a result, pressurized ink displaces air from the return valve and the return line to the Exchanger where it is removed through the open exchanger valve. Once the return line is fully primed, the return valve is closed at step 214. At this point, the system is fully primed with ink.

At step 215, the exchanger valve is closed and, at step 216, the entrance and exit valves are opened. At step 217, the supply and return valve positions are set based upon desired backpressures. At step 218, the pump is activated in the forward direction to pump ink from the printhead to the pressurized ink supply. When, at step 219, the appropriate backpressure is reached in the printhead, as measured by the entrance and/or exit pressure sensors, the printhead nozzles are unblocked at step 220. Because system priming is performed directly from pressurized ink, the priming procedure of the present invention is considerably quicker than prior art techniques that rely on air compression, thereby resulting in quicker start up and priming cycles.

Figure 3:
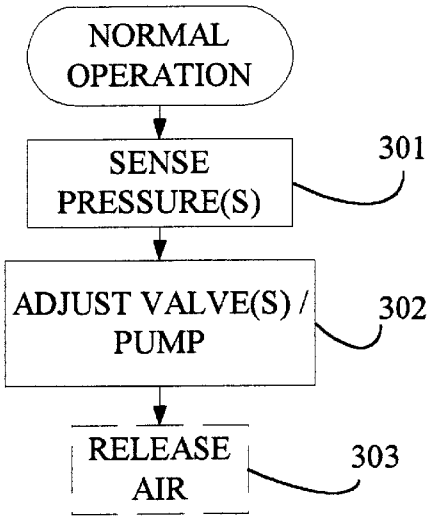
FIG. 3 is flowchart of a normal operating procedure for use in an ink delivery system in accordance with the present invention.

FIG. 3 illustrates normal operating procedures for the ink supply system of FIG. 1. During normal operation, the pressurized ink supply should remain pressurized according to logic programmed into the controller. At step 301, the entrance and/or exit pressure sensors provide entrance and exit pressure signals to the controller. Based on the pressures sensed at step 301, the controller may alter the operating state of either or both of the Supply and return valves. As noted above, in those cases where pumps are used to directly control backpressures along the return lines, operation of the appropriate pumps would be modified at step 302 to provide the desired backpressure adjustments. Additionally, at step 303, the exchanger valve may be opened as needed to release air that accumulates by virtue of normal operation. It should be note that step 303, although shown as a step performed serially after steps 301 and 302, may actually be performed at any time on an as-needed basis. Regulating the pressures in the in supply and return lines in this manner allows much more rapid, economical, and practical backpressure adjustment, without any additional space requirements, in comparison to the prior art.

Figure 4:
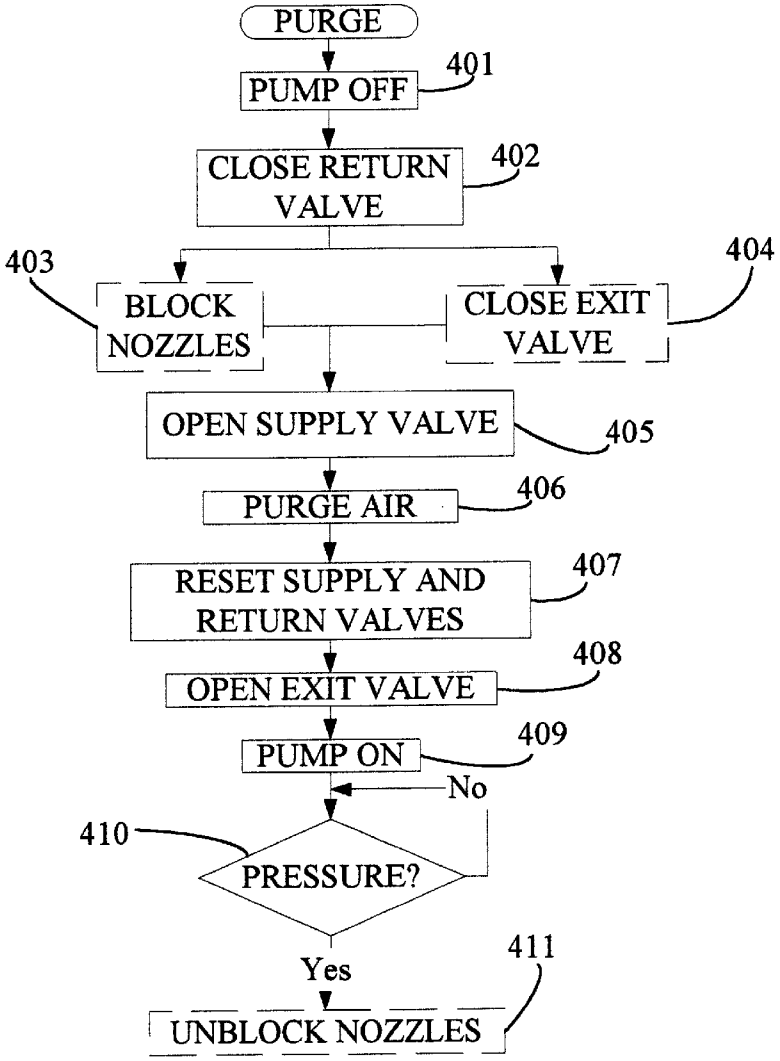
FIG. 4 is flowchart of a purging procedure for use in an ink delivery system in accordance with the present invention.

FIG. 4 illustrates purging procedures for use in purging plugs or air from the ink delivery system. At step 401, the pump is turned off and, at step 402, the return valve is closed. If it is desired to purge air or plugs from the supply line, printhead and return line up to the exchanger, then the nozzles are blocked at step 403. If, however, it is desired to purge air or plugs from the nozzles of the printhead, then the exit valve is closed at step 404. Of course, both of these procedures could be performed in serial fashion if desired.

Regardless, the supply valve is then opened at step 405, thereby allowing pressurized ink to flow to the printhead, where it may purge air and particles from the nozzles, into the exchanger, or both, depending on whether the exit valve is closed and whether the nozzles are blocked. Air is purged from the exchanger via the exchange valve as needed. Once purging has completed, the backpressure settings for the supply and return valves are resumed at step 407. If previously closed, the exit valve is opened at step 408 and the pump is activated for normal operation at step 409. Once the appropriate backpressure is reached in the printhead, the nozzles are unblocked, if previously blocked, at step 411. Once again, the construction of the ink delivery system in accordance with the present invention facilitates necessary purging operations, thereby offering an efficiency over prior art systems.

Figure 5:
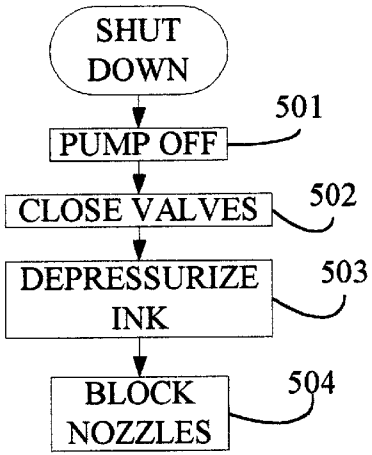
FIG. 5 is flowchart of a shut down procedure for use in an ink delivery system in accordance with the present invention.

FIG. 5 illustrates a shut down procedure in accordance with the present invention. Upon receiving a signal indicating that the ink delivery system is to be shut down (when a power down sequence is begun or after a period of continuous inactivity, for example) the controller, at step 501, turns the pump off. At step 502, the supply, return, entrance, and exit valves are all closed (preferably, their default state when not powered). The ink supply is allowed to depressurize at step 503 and, at step 504, the printhead is blocked or otherwise capped as needed.

Figure 6:
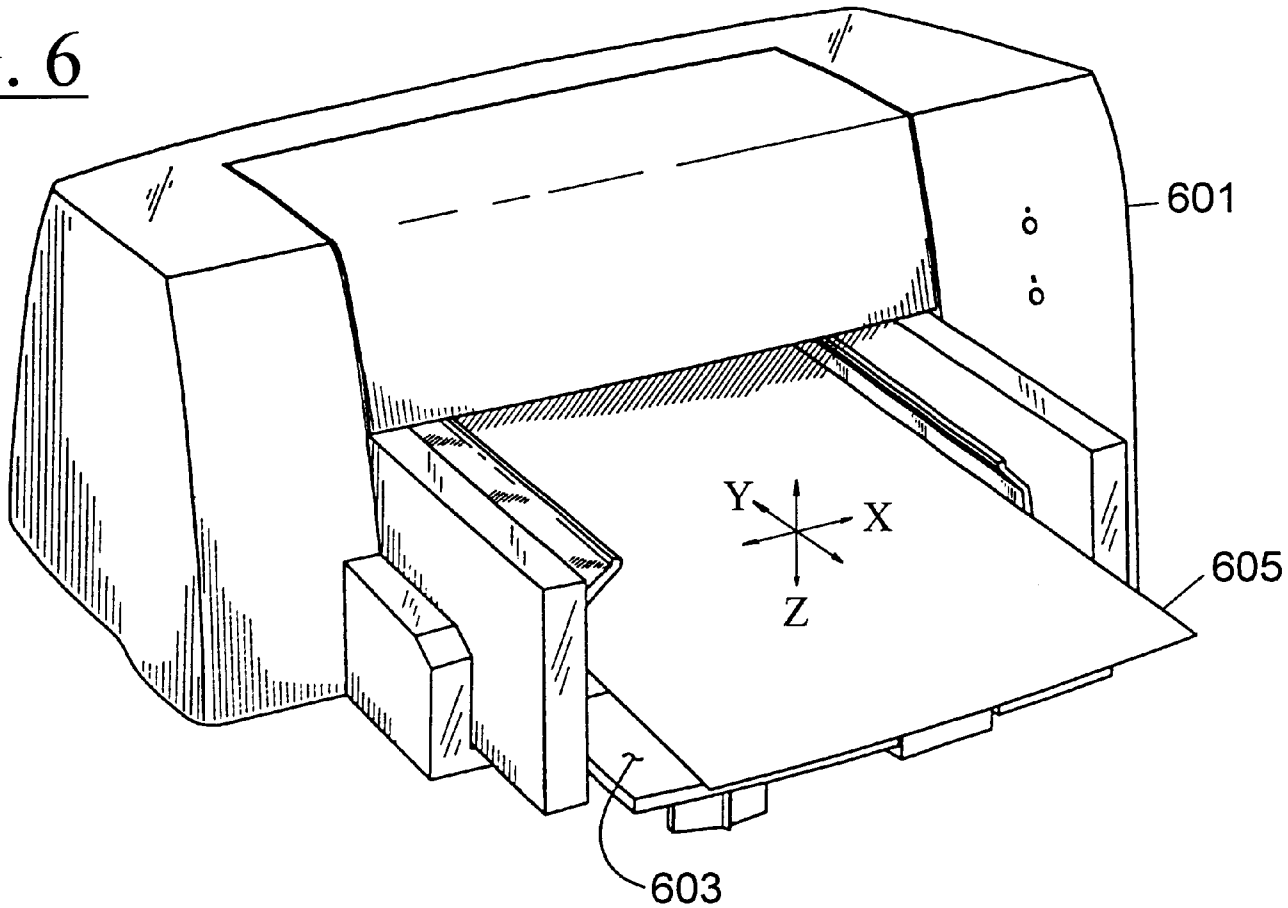
FIG. 6 is an isometric drawing of an exemplary printing apparatus employing the present invention.
Figure 7:
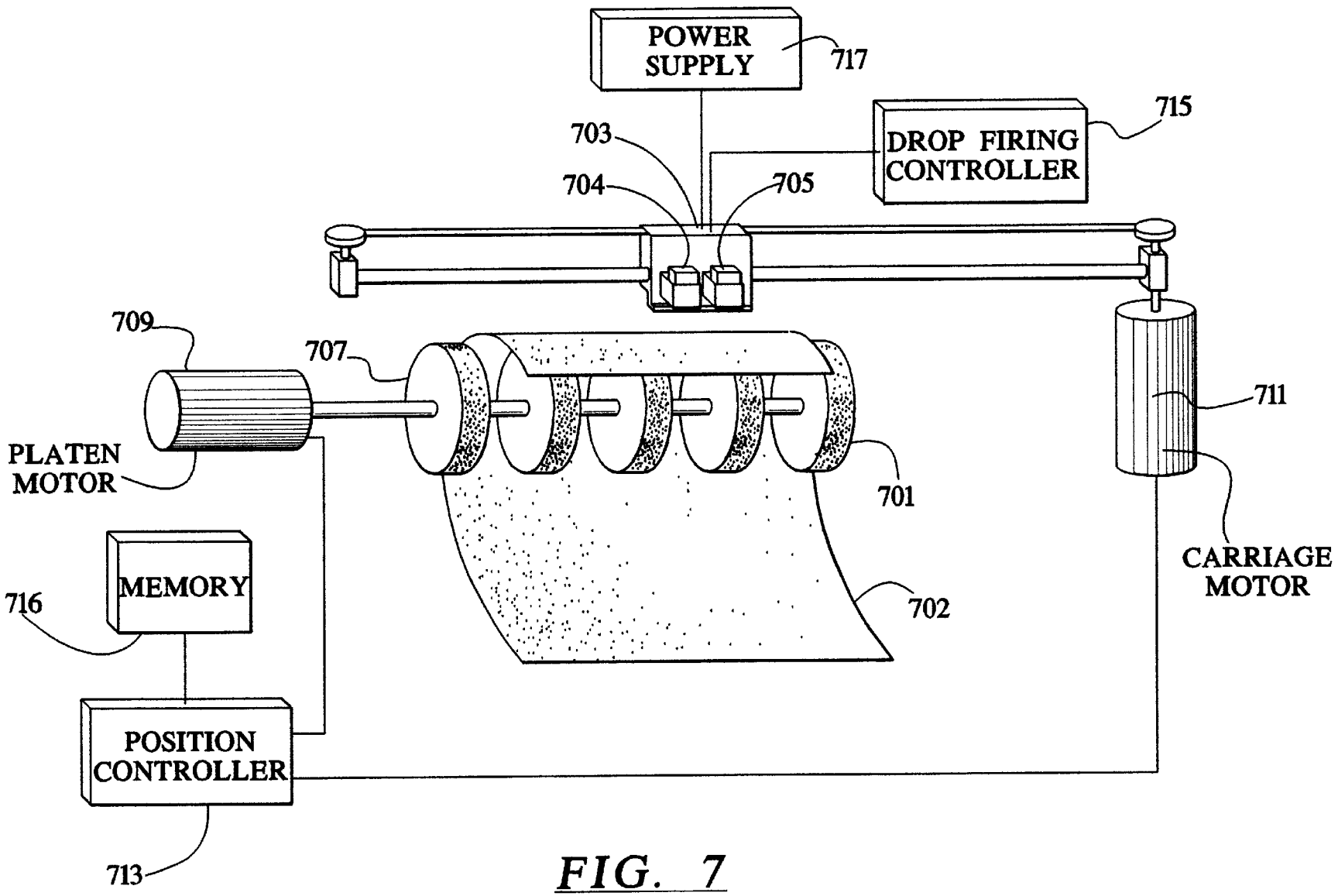
FIG. 7 is a schematic representation of the functional elements of the printer of FIG. 6.

An exemplary inkjet printing apparatus, a printer 601, that may employ the present invention is shown in the isometric drawing of FIG. 6. Printing devices such as graphics plotters, copiers, and facsimile machines may also profitably employ the present invention. A printer housing 603 contains a printing platen to which an input print medium 605, such as paper, is transported by mechanisms that are known in the art. A carriage within the printer 601 holds one or a set of individual print cartridges capable of ejecting ink drops of black or color ink. Alternative embodiments can include a semi-permanent print head mechanism that is sporadically replenished from one or more fluidically-coupled off-axis ink reservoirs, or a single print cartridge having two or more colors of ink available within the print cartridge and ink ejecting nozzles designated for each color, or a single color print cartridge or print mechanism; the present invention is applicable to a print head employed by at least these alternatives. The ink delivery system in accordance with the present invention may be used to supply and recirculate the ink used by printheads in the print cartridges. A carriage 703, which may be employed in the present invention and mounts two print cartridges 704 and 705, is illustrated in FIG. 7. The carriage 703 is typically supported by a slide bar or similar mechanism within the printer and physically propelled along the slide bar to allow the carriage 703 to be translationally reciprocated or scanned back and forth across the print medium 605. The scan axis, X, is indicated by an arrow in FIG. 6. As the carriage 703 scans, ink drops are selectively ejected from the print heads of the set of print cartridges 704 and 705 onto the medium 605 in predetermined print swatch patterns, forming images or alphanumeric characters using dot matrix manipulation. Conventionally, the dot matrix manipulation is determined by a user's computer (not shown) and instructions are transmitted to a microprocessor-based, electronic controller within the printer 601. Other techniques of dot matrix manipulation are accomplished by the computer's rasterizing the data then sending the rasterized data as well as print commands to the printer. The printer interprets the commands and rasterized information to determine which drop generators to fire.

As can be seen in FIG. 7, a single medium sheet 702 is advanced from an input tray into a printer print area beneath the printhead(s) by a medium advancing mechanism including a roller 707, a platen motor 709, and traction devices (not shown). In a preferred embodiment, the inkjet print cartridges 704, 705 are incrementally drawn across the medium 702 on the platen by a carriage motor 711 in the X direction, perpendicular to the Y direction of entry of the medium. The platen motor 709 and the carriage motor 711 are typically under the control of a media and cartridge position controller 713. An example of such positioning and control apparatus may is described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 702 is positioned in a location so that the print cartridges 704 and 705 may eject drops of ink to place dots on the medium as required by the data that is input to a drop firing controller 715 and power supply 717 of the printer. (In practice, the drop firing controller 715 may be implemented as a portion of the controller 101 or vice versa.) These dots of ink are formed from the ink drops expelled from the selected orifices in the print head in a band parallel to the scan direction as the print cartridges 704 and 705 are translated across the medium by the carriage motor 211. When the print cartridges 704 and 705 reach the end of their travel at an end of a print swath on the medium 702, the medium is conventionally incrementally advanced by the position controller 713 and the platen motor 709. Once the print cartridges have reached the end of their traverse in the X direction on the slide bar, they are either returned back along the support mechanism while continuing to print or returned without printing. The medium may be advanced by an incremental amount equivalent to the width of the ink ejecting portion of the print head or some fraction thereof related to the spacing between the nozzles. Control of the medium, positioning of the print cartridge, and selection of the correct ink ejectors for creation of an ink image or character is determined by the position controller 713. The controller may be implemented in a conventional electronic hardware configuration and provided operating instructions from conventional memory 716. Once printing of the medium is complete, the medium is ejected into an output tray of the printer for user removal.

The present invention described above provides an actively-controlled recirculating ink delivery system that overcomes the shortcomings of prior art systems and incorporates active control of downstream pressures to control backpressure. Typical recirculating ink delivery systems are generally better at removing air and heat than common non-recirculating systems. However, these passive, hydrostatically regulated systems generally suffer from limits on the design and layout flexibility of the system by requiring the ink manifolds to be precisely positioned with respect to the printhead. Also, adjusting the backpressure of individual ink channels or all channels as a whole upstream and downstream of the printhead requires independent reservoir positioning systems, which are costly and space-consuming. Further still, such prior art systems suffer from lengthy startup and priming times, thereby decreasing printer throughput. In contrast, the present invention offers all the advantages associated with recirculating ink delivery systems (including the ability to carry away heat generated in the printhead, remove air and particles, and allow pressurized printhead priming) through the use of electronically-controlled components. Not only does this allow for precise control of backpressures, but it also greatly reduces the size and increases the layout flexibility of the ink delivery system. What has been described is merely illustrative of the application of the principles of the present invention. Other arrangements and methods can be implemented by those skilled in the art without departing from the spirit and scope of the present invention.

What is claimed is:

1. An actively-controlled recirculating ink delivery system, comprising:

an ink supply;

a printhead having an ink entrance and an ink exit;

an ink supply line fluidically coupling the ink supply to the printhead ink entrance;

an ink return line fluidically coupling the printhead ink exit to the ink supply, with a pump interposed in the return line between the ink exit and the supply;

a first sensor for providing information on ink pressure in the ink return line; and a controller for receiving information from the first sensor and for generating, based at least in part upon the received ink return pressure information, a control signal for the pump to thereby manage the ink pressure at the printhead.

2. The actively-controlled recirculating ink delivery system of claim 1, wherein the ink supply is pressurized.

3. The actively-controlled recirculating ink delivery system of claim 1, further comprising an exit valve interposed in the ink return line between the printhead ink exit and the pump, the valve controlled by a signal generated by the controller, the generated signal based at least in part upon the received information from the first sensor.

4. The actively-controlled recirculating ink delivery system of claim 1, further comprising:

a first temperature sensor interposed in the ink return line between the printhead ink exit and the pump, the first temperature sensor providing ink exit temperature information to the controller; and wherein the control signal for the pump generated by the controller is based at least in part on the ink exit temperature information.

5. The actively-controlled recirculating ink delivery system of claim 4, wherein the first temperature sensor comprises a thermocouple.

6. The actively-controlled recirculating ink delivery system of claim 4, further comprising a heat/air exchanger interposed in the return line between the ink exit and the pump.

7. The actively-controlled recirculating ink delivery system of claim 6, wherein the heat/air exchanger further comprises an exchanger valve controlled by a signal generated by the controller based at least in part on the ink exit temperature information.

8. The actively-controlled recirculating ink delivery system of claim 1, further comprising an entrance valve interposed in the ink supply line between the ink supply and the printhead ink entrance, the entrance valve controlled by a signal generated by the controller, the generated signal based at least in part upon the received information from the first sensor.

9. The actively-controlled recirculating ink delivery system of claim 7, further comprising a second sensor pressure sensor, the second pressure sensor interposed in the ink supply line between the entrance valve and the printhead ink entrance, the second sensor providing to the controller information on ink pressure in the ink supply line.

10. The actively-controlled recirculating ink delivery system of claim 1, further comprising:

a second temperature sensor interposed in the ink supply line between the entrance valve and the printhead ink entrance, the second temperature sensor providing ink entrance temperature information to the controller; and wherein the control signal for the pump generated by the controller is based at least in part on the ink entrance temperature information.

11. The actively-controlled recirculating ink delivery system of claim 10, wherein the second temperature sensor comprises a thermocouple.

12. The actively-controlled recirculating ink delivery system of claim 11, further comprising a compliant element interposed in the ink supply line.

13. The actively-controlled recirculating ink delivery system of claim 1, further comprising a filter interposed in the ink supply line.

* * * * *